US005635334A

United States Patent [19]

Borland et al.

[11] Patent Number: 5,635,334

[45] Date of Patent: Jun. 3, 1997

[54] PROCESS FOR MAKING PLASMA DISPLAY APPARATUS WITH PIXEL RIDGES MADE OF DIFFUSION PATTERNED DIELECTRICS

[75] Inventors: William Borland, Cary, N.C.; Ryosuke Kuwada; Noboru Nishii, both of Tokyo, Japan; Carl B. Wang, Chapel Hill, N.C.; Yasuo Yamamoto, Tokyo, Japan

[73] Assignee: E. I. Du Pont de Nemours and Company, Wilmington, Del.

[21] Appl. No.: 397,446

[22] Filed: Mar. 1, 1995

Related U.S. Application Data

[63] Continuation-in-part of Ser. No. 109,879, Aug. 20, 1993, abandoned.

[30] Foreign Application Priority Data

Aug. 21, 1992 [JP] Japan ..... 4-222413

[51] Int. Cl.[6] ..... G03C 5/00

[52] U.S. Cl. ..... 430/311; 430/315; 216/20

[58] Field of Search ..... 430/311, 312, 430/313, 315, 320; 313/582; 216/20

[56] References Cited

U.S. PATENT DOCUMENTS

| | | | |
|---|---|---|---|
| 5,032,216 | 7/1991 | Felten | 156/628 |
| 5,037,723 | 8/1991 | Hwang | 430/320 |
| 5,136,207 | 8/1992 | Miyake et al. | 313/582 |
| 5,385,631 | 1/1995 | Tamemasa et al. | 156/628 |

FOREIGN PATENT DOCUMENTS

| | | |
|---|---|---|
| 0 382 260 | 2/1990 | European Pat. Off. . |
| 2-250236 | 10/1990 | Japan . |
| 2-250245 | 10/1990 | Japan . |
| WO91/06118 | 5/1991 | WIPO . |

*Primary Examiner*—S. Rosasco

[57] ABSTRACT

The invention relates to an improved method for making a plasma display apparatus comprising a plurality of stripe-shaped electrodes arranged in a matrix, a dot-shaped discharge area or pixel area at each solid intersection between the stripe-shaped electrodes and a fluorescent film formed on each of the discharge areas and adapted to emit light when the fluorescent film is excited by ultraviolet rays from the corresponding discharge area wherein the improvement is fabricating a ridge on one of the substrates utilizing a negative-working or positive-working diffusion patterning process.

4 Claims, 9 Drawing Sheets

PROCESS FOR MAKING PLASMA DISPLAY APPARATUS WITH PIXEL RIDGES MADE OF DIFFUSION PATTERNED DIELECTRICS

CROSS REFERENCE TO RELATED APPLICATION

This application is a continuation-in-part of U.S. application Ser. No. 08/109,879, filed Aug. 20, 1993, now abandoned, which claims the benefit of Japanese Application No. 4-222413, filed Aug. 21, 1992.

FIELD OF INVENTION

The invention relates to an improved method for making plasma display apparatus with pixel ridges.

BACKGROUND OF THE INVENTION

The plasma display apparatus typically comprises a pair of front and rear insulation substrates arranged opposed to each other to form a discharge space therebetween, said discharge space containing a gaseous mixture of He with a trace of Xenon and others, a group of stripe-shaped electrodes on the opposed surfaces of said insulation substrates, said stripe-shaped electrodes being arranged to form a matrix pattern in said discharge space, said matrix parting said discharge space into a plurality of discharge gas containing sub-spaces, each intersection between said stripe-shaped electrodes corresponding to a pixel, and a fluorescent film in each of said sub-spaces.

More particularly, as shown in FIG. 10, the front insulation substrate 301 is formed of sheet glass, with the internal surface thereof including a film-type light-blocking mask 302 formed thereon and first stripe-shaped electrodes 303 arranged side by side on the internal surface of the substrate 301 in one direction, these electrodes 303 functioning as anodes. The internal surface of the other or backward substrate 304 is similarly formed of sheet glass and the internal surface thereof includes second stripe-shaped electrodes 307 arranged to extend in a direction perpendicular to the lengths of the first electrodes 303, these electrodes 307 functioning as cathodes. The first and second electrodes 303, 307 are separated from each other by dielectric partitions 308. FIG. 10 also exhibits a trigger electrode 311, separated from the second electrode 307 by an insulation dielectric layer 314. A dot-like discharge area 309 is formed at each of the intersections between the first and second electrodes 303 and 307. The discharge area 309 contains a discharge gas containing Xenon. A dot-like fluorescent film 310 for color display is formed on the surface of each of the first electrodes 303.

Each of the partitions 308 is formed to have a thickness ranged between 100 microns and 200 microns by repeated thick-film printing of insulation paste. The discharge gas is a two-component mixture gas containing He, Xe, a three-component mixture gas containing He, Xe, and any other suitable component or a single gas (e.g. Xe). The discharge gas is sealed within the corresponding discharge area 309 under the pressure of 10 to 500 Torr., depending on the composition thereof. Upon a voltage application, the discharge gas generates an UV radiation 315 which reacts with the fluorescent film 310 and emits a visible light 316.

Such a plasma display apparatus of the prior art was provided by repeating the thick film process to form partitions having a thickness ranged between 100 microns and 200 microns on an insulation substrate to define a plurality of dot-like discharge areas thereon or by performing the thick film printing process to form partitions as described, applying a paste containing silver in a groove surrounded and defined by said partitions, and firing the paste to form a group of electrodes. Thereafter, a fluorescent material is placed and fired in a recess formed by said partitions to form a fluorescent member covering one of the electrodes (i.e. one disposed on the backside of the substrate). When these front and rear substrates are superposed on each other, sealing, discharging and other gases are sealed therebetween to complete a plasma display apparatus.

The prior art process requires too many producing steps which would reduce the mass-productibility and increase the manufacturing cost. Since the electrodes, partitions and others are formed by repeating the thick-film printing and firing steps, possible dot pitch is limited. The thickness of film must be controlled with high accuracy. Further, the substrates must be superposed and fixed to each other with a high precision.

SUMMARY OF THE INVENTION

An object of the invention is to provide a plasma display apparatus which can be produced more easily and inexpensively and which can operate more stabily.

Another object of the invention is to produce a plasma display apparatus having a number of electrodes disposed with a reduced dot pitch.

The invention is therefore directed to a plasma display apparatus which comprises a first or front dielectric substrate or a second or rear dielectric substrate; a plurality of first electrodes extending in one direction on the first or second substrate or a plurality of second electrodes on the second substrate extending in another direction perpendicular to the direction of first electrode; a ridge defining a plurality of pixel areas and being adapted to provide a partition wall and fluorescent materials provided in said pixel areas, the improvement in which the ridge is fabricated by a diffusion patterning process by which a patterned layer of dielectric and an underlying unpatterned layer of dielectric are applied onto at least one of the substrates and the patterned layer formed with an image of said ridge is diffused into said unpatterned layer.

Further, the invention is directed to a process of making a plasma display apparatus, comprising the steps of providing dielectric substrates; forming a plurality of first electrodes on one of said substrates to extend in one direction; forming a plurality of second electrodes on the other substrate to extend in another direction perpendicular to said one direction; forming a ridge on at least one of said substrates to define a plurality of pixel areas; and providing fluorescent materials in said pixel areas, the improvement in which the ridge is fabricated by a diffusion patterning process by which a patterned layer of dielectric and an underlying unpatterned layer of dielectric are applied onto at least one of the substrates and the patterned layer formed with an image of said ridge is diffused into said unpatterned layer.

In such an arrangement of the present invention, there can be employed the diffusion patterning for use on layers of small thickness such as those used in the fabrication of electronic components. Typically the patterned layer of dielectric will range from 10 to 30 microns while the unpatterned layer of dielectric can be of much greater thickness from 10 to 100 microns. The thickness of the patterned layer is limited chiefly by the method of application rather than by considerations of operability.

The amount of solubilizing agent in the patterned layer must be sufficient to provide a solubilizing amount by diffusion to the underlying layer. Thus, the patterned layer will contain at least 10% weight solubilizing agent and may contain as much as 90% weight depending upon the solubility relationships of the respective polymers.

Furthermore, in some instances, it may be desirable to add a plasticizer or other solubilizing agent to the underlying unpatterned layer in order to make the polymer more susceptible to the action of the solubilizing agent which is diffused from the patterned layer.

By and large, the individual steps for preparation of components for the plasma display apparatus of the invention are similar to those which are known by those skilled in the art of conventional thick film, green tape, and polymer technology. Thus, the following procedures may not be new by themselves, but illustrate a preferred method for formulating and preparing the materials to be used in the invention.

The dielectric pastes for the formation of the unpatterned layer are typically printed twice with 200 mesh screens at one to two inches per second squeegee speed. The patterning pastes are printed over the dielectric at higher speeds, since only a small part of the screen is open mesh.

The conductor pastes for the formation of electrodes are printed with a 325 or 400 mesh screen, depending on the conductor thickness and resolution desired. Patterning pastes are likewise printed with a 325 or 400 mesh screen, to optimize the amount of plasticizer delivered to the underprint. Thinner screens and fewer prints are needed than with the dielectric, because of the thinner films typically used with conductors.

Any polymers known in the art can be used as the material for the preparation of the above pastes. Representative examples of those polymers include cellulosic polymers such as ethyl cellulose, polystyrene polyacrylates (including methacrylates), poly(vinyl acetate), poly(vinyl butyral), poly(vinyl chloride), phenol-formaldehyde resins or the like.

It will be recognized by those skilled in polymer technology that each polymer species is compatible with a large number of different types of plasticizers or non-volatile solvents. As a result, the number of suitable polymer/solvent/non-solvent combinations is legion.

Following are examples of several commercially available plasticizers which are compatible with ethyl cellulose, a typical polymer used in the patterning paste: acid esters of abietic acid (methyl abietate), acetic acid esters (cumphenylacetate), adipic acid derivatives (e.g. benzyloctyl adipate), diisodecyl adipate, tridecyl adipate), azelaic acid esters such as diisooctyl azelate, diethylene glycol dibenzoate, triethylene glycol dibenzoate, citrates such as triethyl citrate, epoxy type plasticizers, polyvinyl methyl ethers, glycerol mono-, di-, and triacetates, ethylene glycol diacetate, polyethylene glycol 200 to 1000, phthalate esters (dimethyl to dibutyl), isophthalic acid esters (dimethyl, diisooctyl, di-2-ethylhexyl), mellitates such as trioctyl trimellitate and isooctylisodecyl trimellitate, isopropyl myristate, methyl and propyl oleates, isopropyl and isooctyl palmitates, chlorinated paraffin, phosphoric acid derivatives such as triethyl phosphate, tributyl phosphate, tributoxyethyl phosphate, triphenyl phosphate, polyesters, dibutyl sebacate, dioctyl sebacate, stearates such as octyl stearate, butoxyethyl stearate, tetramethylene glycol monostearate, sucrose derivatives such as sucrose octoacetate, sulfonic acid derivatives such as benzenesulfonmethylamide, or dioctyl terephthalate.

Solvent/non-solvent systems for the ethyl cellulose/plasticizer combinations include:

Solvents: (D.S. denotes degree of substitution with ethoxyl groups.) D.S.=1.0 to 1.5: Pyridine, formic acid, acetic acid, water (cold) D.S.=2 Methylene chloride, chloroform, dichloroethylene, chlorohydrins, ethanol, THF. D.S.=2.3 Benzene, toluene, alkyl halogenides, alcohols, furan derivatives, ketones, acetic esters, carbon disulfide, nitromethane. D.S.=3.0 Benzene, toluene, methylene chloride, alcohols, esters.

Non-Solvents: D.S.=1.0 to 1.5: Ethanol. D.S.=2.0 Hydrocarbons, carbon tetrachloride, trichloroethylene, alcohols, diethyl ether, ketones, esters, water. D.S.=2.3 Ethylene glycol, acetate (cold). D.S.=3.0 Hydrocarbons, decalin, xylene, carbon tetrachloride, tetrahydrofurfuryl alcohol, diols, n-propyl ether.

DETAILED DESCRIPTION OF THE INVENTION

Figure 1:
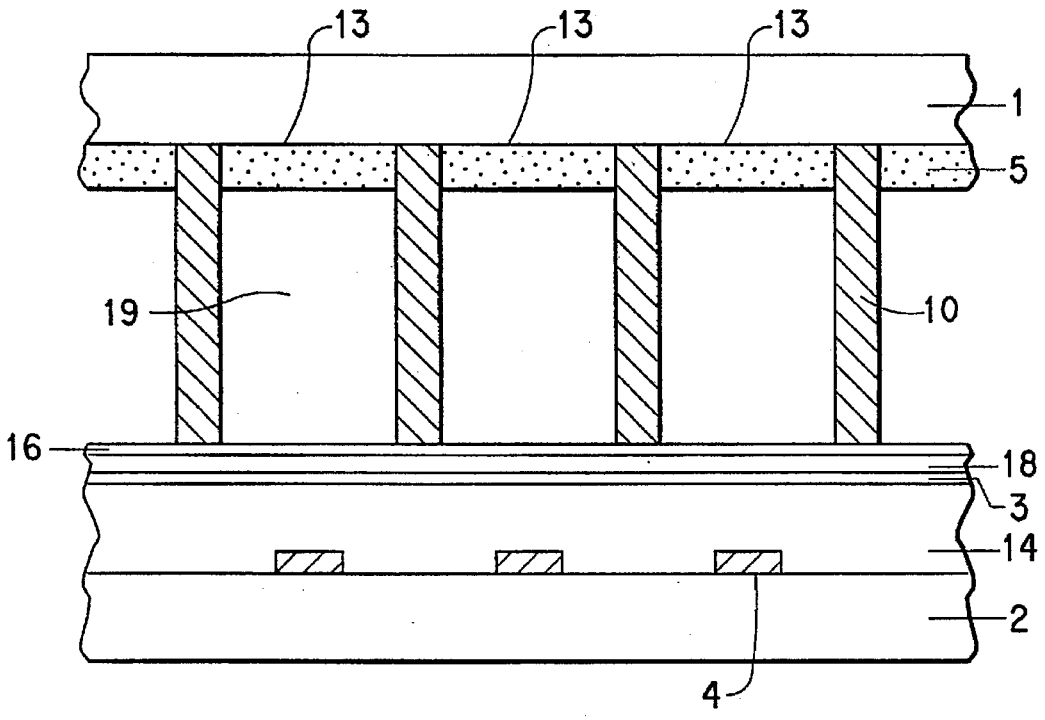
FIG. 1 is a cross sectional view of the primary parts of a plasma display apparatus constructed in accordance with the present invention.
Figure 2:
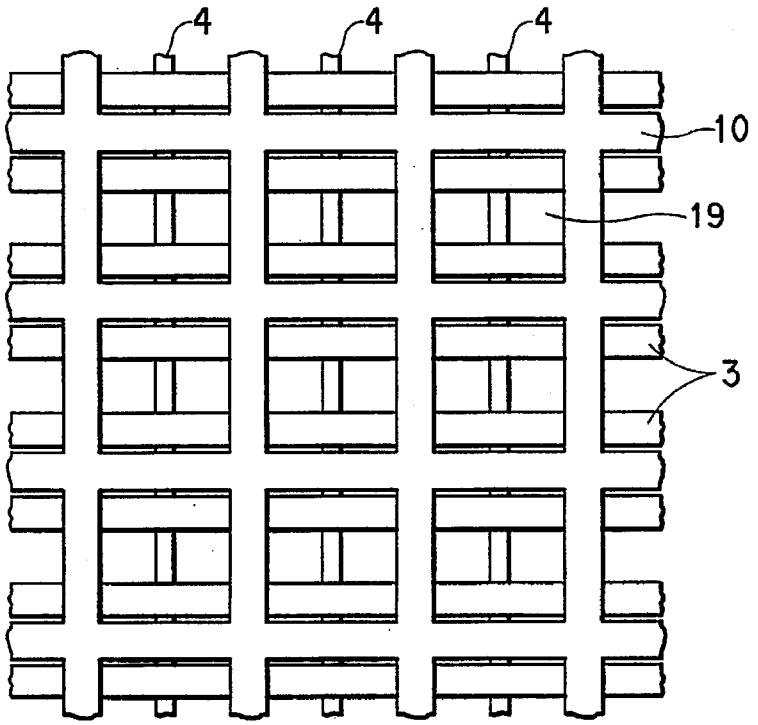
FIG. 2 is a top view of the plasma display apparatus, showing the relative position of electrodes, ridges, and discharge areas.
Figure 3:
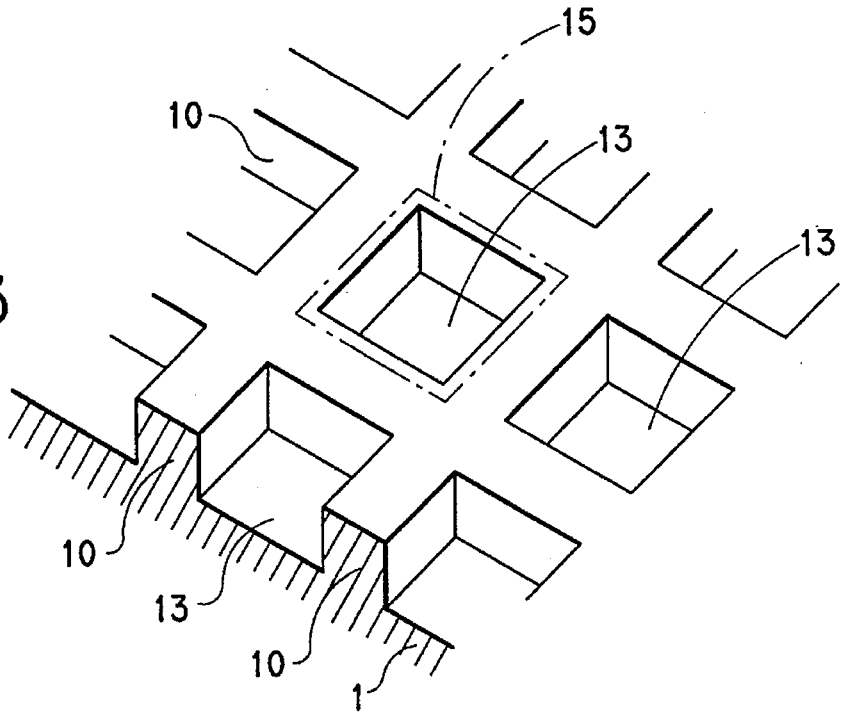
FIG. 3 is a three dimensional view showing the structures of ridges, discharge area, and fluorescent members.

Referring first to FIGS. 1, 2, and 3 there is shown a plasma display apparatus of the present invention which comprises first and second dielectric substrates 1, 2 of a sheet glass having a thickness equal to 2 mm, a plurality of X electrodes 3 (first electrodes) laterally extending on the inner surface of the second or rear substrate 2, a plurality of Y electrodes (second electrodes) longitudinally extending on the inner face of the second substrate 2, and a plurality of fluorescent materials 5 for converting discharged ultraviolet rays into visible rays. The plasma display apparatus also comprises a matrix-like (or mesh-like) ridge 10 built on substrate 1 which defines a plurality of pixel areas and is adapted to provide a partition wall for maintaining the spacing between the first and second substrates 1, 2. Each of the (line) X electrodes 3 is disposed on dielectric layer 14 to electrically insulate from the (column) Y electrodes, and another dielectric layer 18 is arranged over the line electrodes 3 to separate from a discharge space 19. Protective layer 16 may be provided on dielectric layer 18. Each of the fluorescent materials 5 is formed by pouring a luminescence color fluorescent material into each of recesses 13 which are formed by the matrix-like ridge 10 on substrate 1. The fluorescent material may be $Zn_2SiO_4$:Mn for green color, $(Y_1Gd)\ BO_3:Eu^{3+}$ for red color or $BaMgAl_{14}O_{23}:Eu^{2+}$ for blue color.

A discharge space 19 formed between the substrates 1, 2 by the matrix-like ridge 10 is filled with any suitable mixture gas, for example, consisting of neon and xenon. A discharge cell is formed at each of the intersections between the X electrodes 3 and the Y electrodes 4. When each discharging cell is energized, one fluorescent material 5 corresponding to the energized cell is excited to emit light.

In such an arrangement, the fluorescent material 5 may be selectively excited through the intersecting electrodes 3 and 4. As to the plasma display apparatus of the invention, any structural members mentioned from now are referred to FIGS. 1–3.

Figure 4:
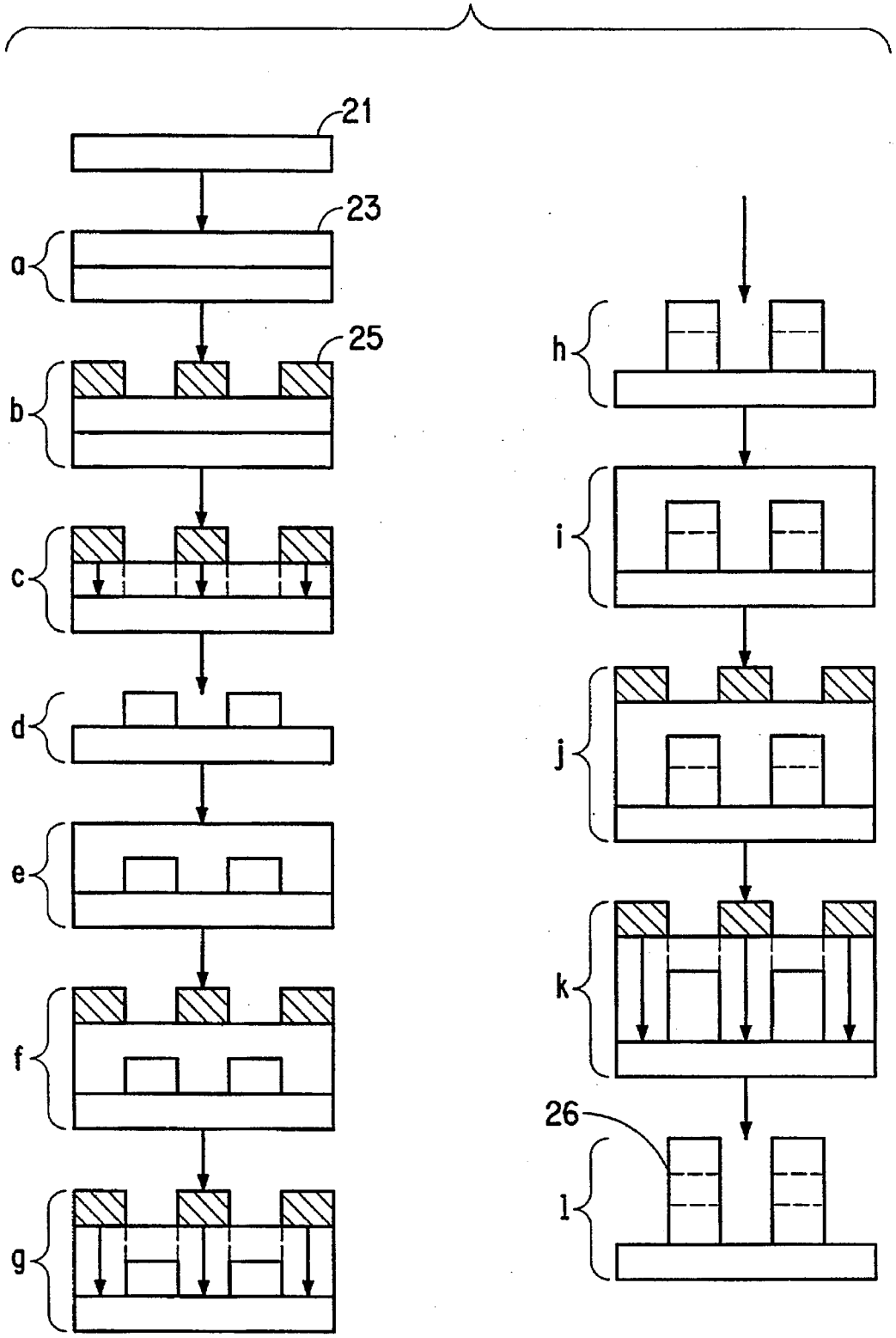
FIG. 4(*a–l*) contains a series of views illustrating a sequence of steps 4-*a* to 4-*l* where the "develop" step follows each "diffusion" step in the negative-acting diffusion patterning process to make the ridges for the current invention.
Figure 5:
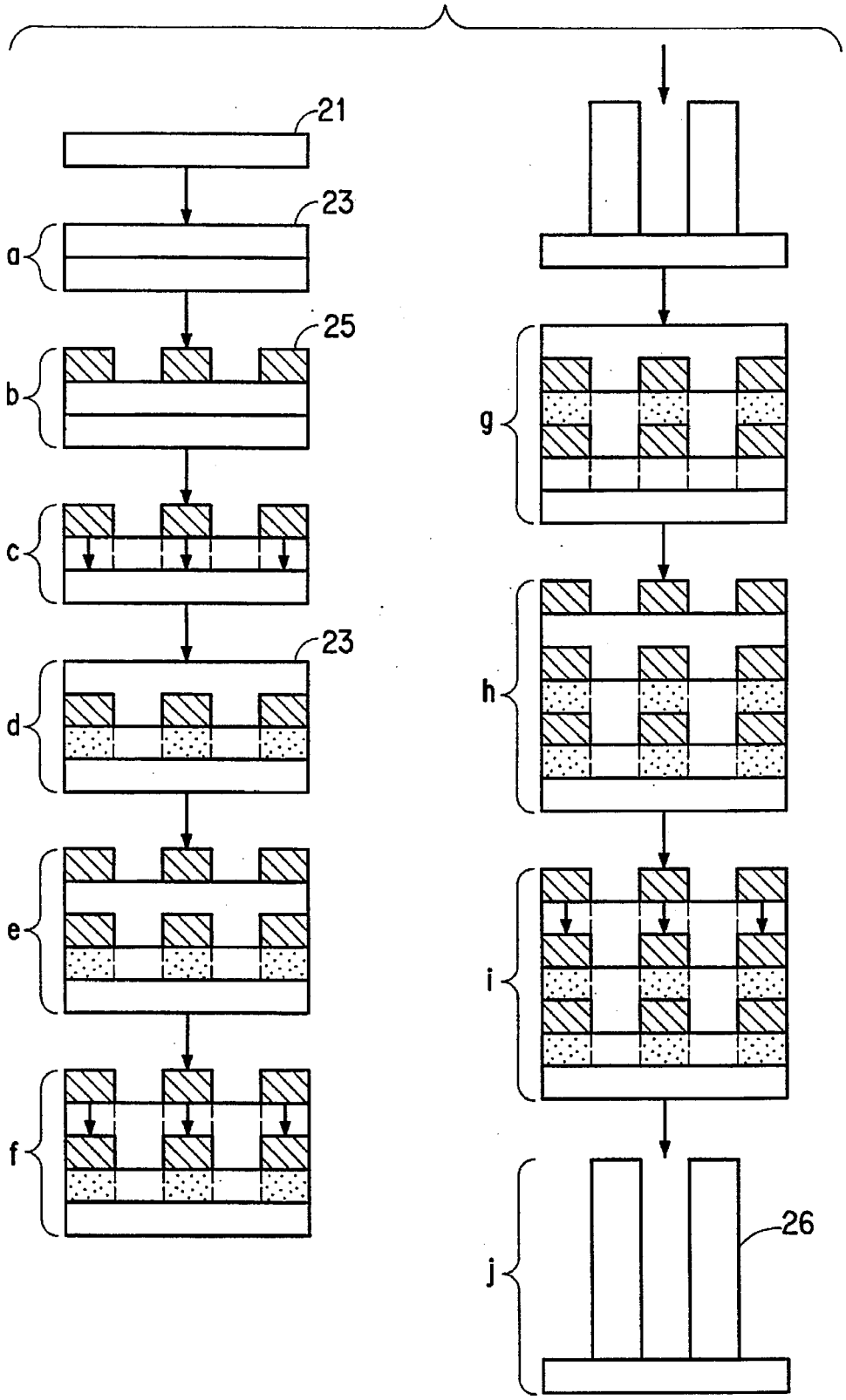
FIG. 5(*a–j*) contains a series of views illustrating a sequence of steps 5-*a* to 5-*j* where only one "develop" step is applied after the last "diffusion" step in the negative-acting diffusion patterning process to make the ridges for the current invention.

The ridge in the plasma display apparatus may be produced in accordance with a negative-acting diffusion patterning process shown in FIGS. 4 and 5. The plasma display apparatus is fabricated with a ridge 10 or a partition wall structure which is negatively patterned and sequentially developed as shown in FIG. 4 or negatively patterned and co-developed (as illustrated in FIG. 5) using diffusion patterning.

As illustrated in FIG. 4, a layer 23 of thick film dielectric paste is applied by screen printing to glass substrate 21. The thick film paste is comprised of finely divided particles of glass dispersed in an organic medium comprising an acid labile polymer dissolved in dibutyl phthalate plasticizer and terpineol. After printing the layer 23, the terpineol is removed by heating the layer to a temperature of 80° C. for a period of about 10 minutes.

A patterned second layer 25 is screen printed over the solvent-free thick film layer 23, the second layer 25 is a liquid solution comprised of p-toluene sulfonic acid, dibutyl phthalate and terpineol, as shown in FIG. 4(*b*).

Upon forming the patterned layer 25, the assemblage is heated to 90° C. during which the terpineol is evaporated from the layer and the acid and dibutyl phthalate are diffused into the underlying areas of thick film dielectric layer 23 whereby the acid reacts with the acid labile groups of the polymer to render it water dispersible (FIG. 4(*c*)).

The patterned layer 25 consists mainly of small amounts of residual acid and dibutyl phthalate. It is then washed with water having a pH of at least 7 to remove the underlying diffusion patterned layer 25, which consists largely of the solubilized acid labile polymer and the other materials in the underlying imaged areas of thick film layer 23. Upon completion of the washing, the surface of substrate 21 is exposed in the areas which underlay the pattern of layer 25 and a very precise negative image of the pattern remains on the surface of substrate 21 (FIG. 4(*d*)). The thus patterned dielectric is subsequently fired. FIG. 4(*e*) through 4(*l*) repeat the process hereinabove which thickens the patterned layer to the desired height.

In such a manner, a matrix-like ridge 26 is formed by the layer such that a discharge space for each pixel area is formed having, for example, a depth ranged between 25 and 100 microns and a x/y dimension depending on the pitch size of pixel. When it is desirable to obtain a thicker or more raised ridge, one may repeat a series of the steps of dielectric print/dry through development as shown in FIGS. 4–9. FIG. 5 builds on FIG. 4 and illustrates schematically the process of producing the same negatively patterned and co-developed by use of 2 or 3 diffusion patterning steps (FIG. 5*g*–5*j*).

After desirable thickness of the ridge is obtained, the dielectric is fired on the surface of the glass substrate 21, conductor is applied to form the line and column of electrodes on the other glass substrate 2 of FIG. 1 opposing the substrate 21 as described previously. Each group of the electrodes is formed by the screen printing process (thick film process) wherein a paste containing a metal selected from the group consisting of Au, Ni, Al, Cu, and silver as a principal component is applied and then fired to form an electrode layer. The material of this electrode layer is then partially removed to form the electrodes. Thus, the width of the electrode layer may be larger than that of the final electrode.

Returning to FIG. 1, by the use of the screen printing process, the overall surface of the glass substrate 2 is coated with a lead borate, low melting glass paste containing a dielectric material such as aluminum oxide or silicon oxide. The paste is then fired to form dielectric layers 14 and 18. The glass substrate 2 may include a protective layer 16 of magnesium oxide which is formed over the dielectric layer.

Each of the recesses 13 defined by the ridge 10 on substrate 1 is filled with a fluorescent material 5 at the bottom.

When used for monocolor display, each of the flourescent material 5 is formed by depositing a fluorescent material on the inner bottom surface 13 of the corresponding recess, for example, $Zn_2SiO_4$ emitting a green-colored light. If it is wanted to provide a multicolor display, fluorescent materials for emitting red(R)-, green(G)- and blue(B)-colors are sequentially deposited on the inner bottom surface of each discharge area for each pixel area line in the X or Y direction or for each pixel area 15 (FIG. 3).

When it is desirable, the said diffusion patterning process may be applied to both substrates 1 and 2 to fabricate the ridge or the entire partition wall.

Thereafter, the glass substrate 2 is superposed over the display side glass substrate 1. The space between the glass substrates 1, 2 is sealed by sealing glass and at the same time a discharge mixture gas is sealed in the space. A plasma display apparatus is thus assembled.

Figure 6:
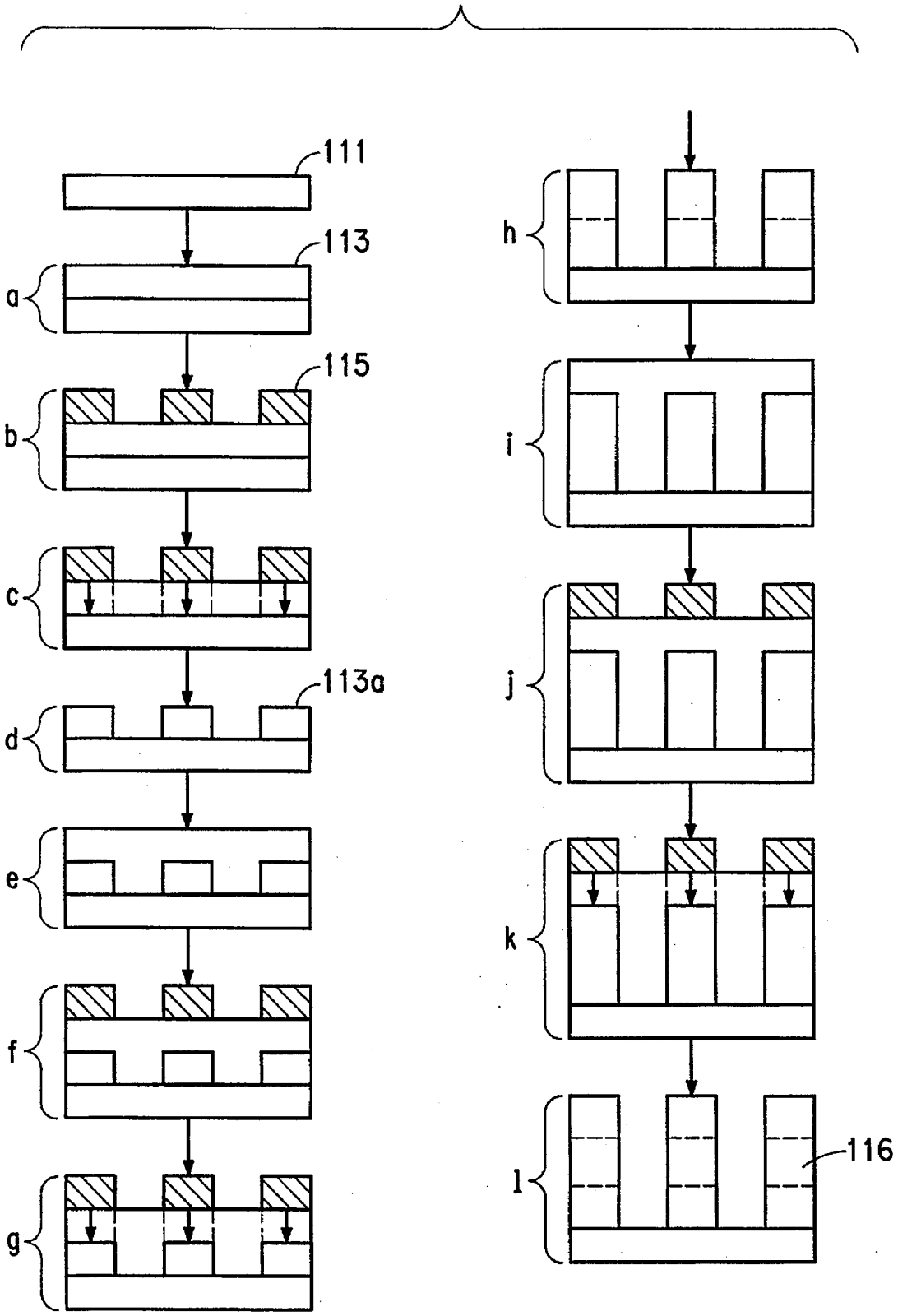
FIG. 6(*a–l*) contains a series of views illustrating a sequence of steps 6-*a* to 6-*l* similar to those of FIG. 4 except a positive-acting diffusion patterning process is used and the patterned dielectric layer 115 is removed after developing to make the ridges for the current invention.
Figure 7:
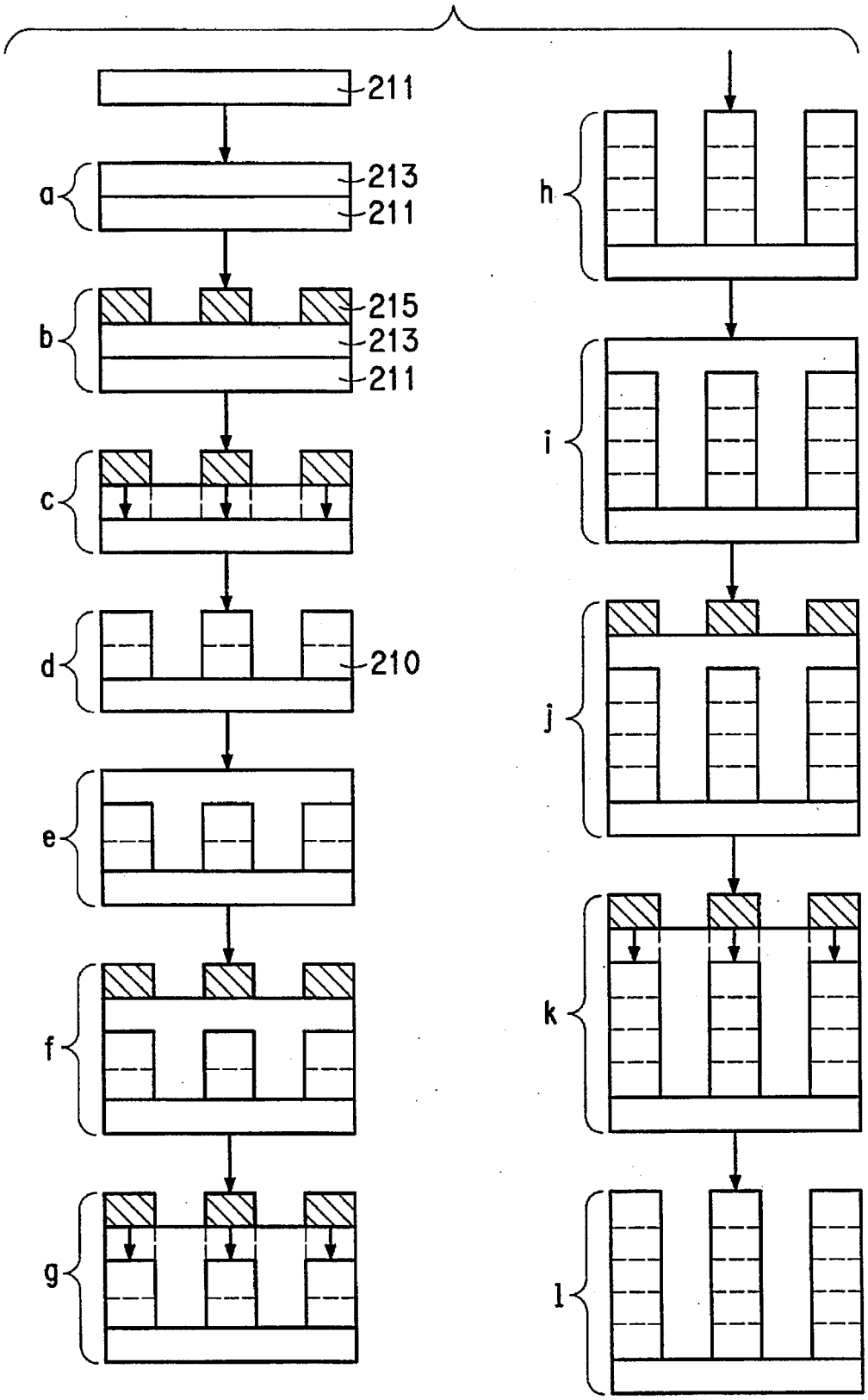
FIG. 7(*a–l*) contains a series of views illustrating a sequence of steps 7-*a* to 7-*l* similar to those of FIG. 6 except patterned dielectric layer 115 is kept after developing to make the ridges for the current invention.

Referring further to FIGS. 6 and 7, an alternative process of fabricating a ridge or partition wall in the plasma display apparatus of the invention is explained, for instance, a positive-acting non-photographic method for making patterns in dielectric films comprising the sequential steps:

FIG. 6(*a*). Applying to a substrate 111 an unpatterned first layer 113 comprising a solid organic polymer which is soluble in a predetermined solvent or water;

FIG. 6(*b*). Applying to the unpatterned first layer 113 a patterned second layer 115 comprising a desolubilizing agent which is capable of decreasing the solubility of the organic polymer in the solvent;

FIG. 6(*c*). Heating the patterned second layer 115 to effect patterned diffusion of the desolubilizing agent into the underlying first organic polymer layer 113 and to render the diffusion patterned areas of the polymer in the first layer 113 insoluble in the solvent; and FIG. 6(*d*). Removing the non-patterned areas of the underlying first layer 113A by washing them in the predetermined solvent.

FIG. 6(*e*)–6(*l*) repeat the process until desired thickness of the ridge 116 is obtained.

If the insolubilizer-depleted areas of the patterned second layer 115 are soluble in the solvent, they will be removed during the solvent-washing step (FIG. 6(*a*) to (*d*)). On the other hand, if the insolubilizer-depleted areas of the patterned second layer FIG. 7, 215 are insoluble in the solvent, they will remain after the solvent-washing step (FIG. 7(*a*) to (*d*)). In FIG. 7, 211 is the substrate and 2B is the first organic polymer layer.

After the first developing step, the unpatterned layer 113A (FIG. 6(*d*)) comprising an organic polymer or the patterned layer 115 comprising a polymer insoluble in the solvent and the corresponding organic polymer layer 113A (FIG. 7(*d*)) are left on the substrate to form a matrix-like ridge 210 defining pixel areas in the plasma display and forming a discharge space. The remaining steps (6*e*–6*l*) and (7*e*–7*l*) for producing the plasma display are similar to those of the aforementioned process.

A plurality of positive-acting diffusion patterning steps may be used to build up partition wall thickness. FIGS. 6 and 7 illustrate schematically the steps involved to apply up to 3 diffusion patterning steps.

Figure 8:
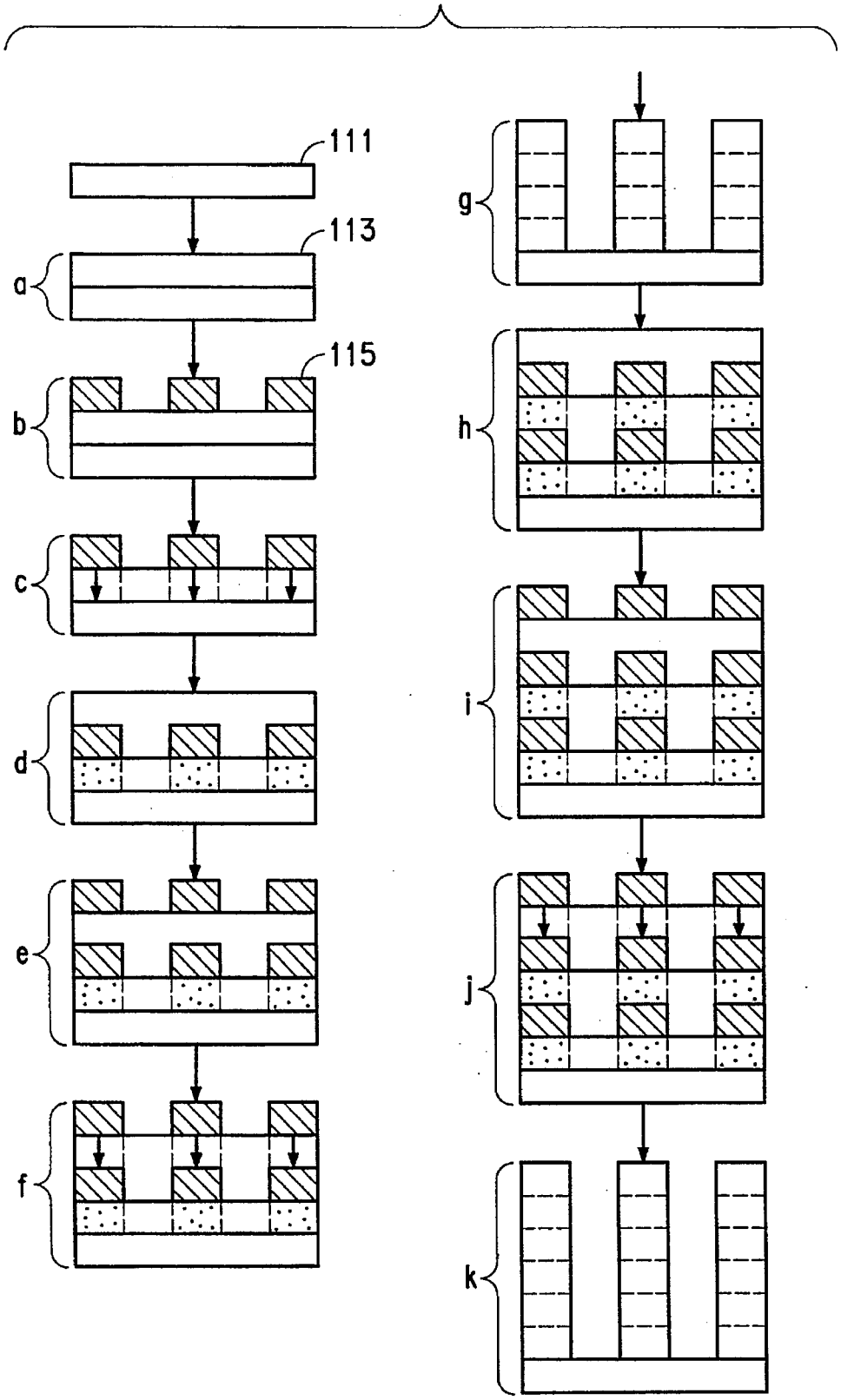
FIG. 8(*a–k*) contains a series of views illustrating a sequence of steps 8-*a* to 8-*k* similar to those of FIG. 5 except a positive-acting diffusion patterning process is used and the patterned dielectric layer 115 is kept after developing to make the ridges for the current invention.
Figure 9:
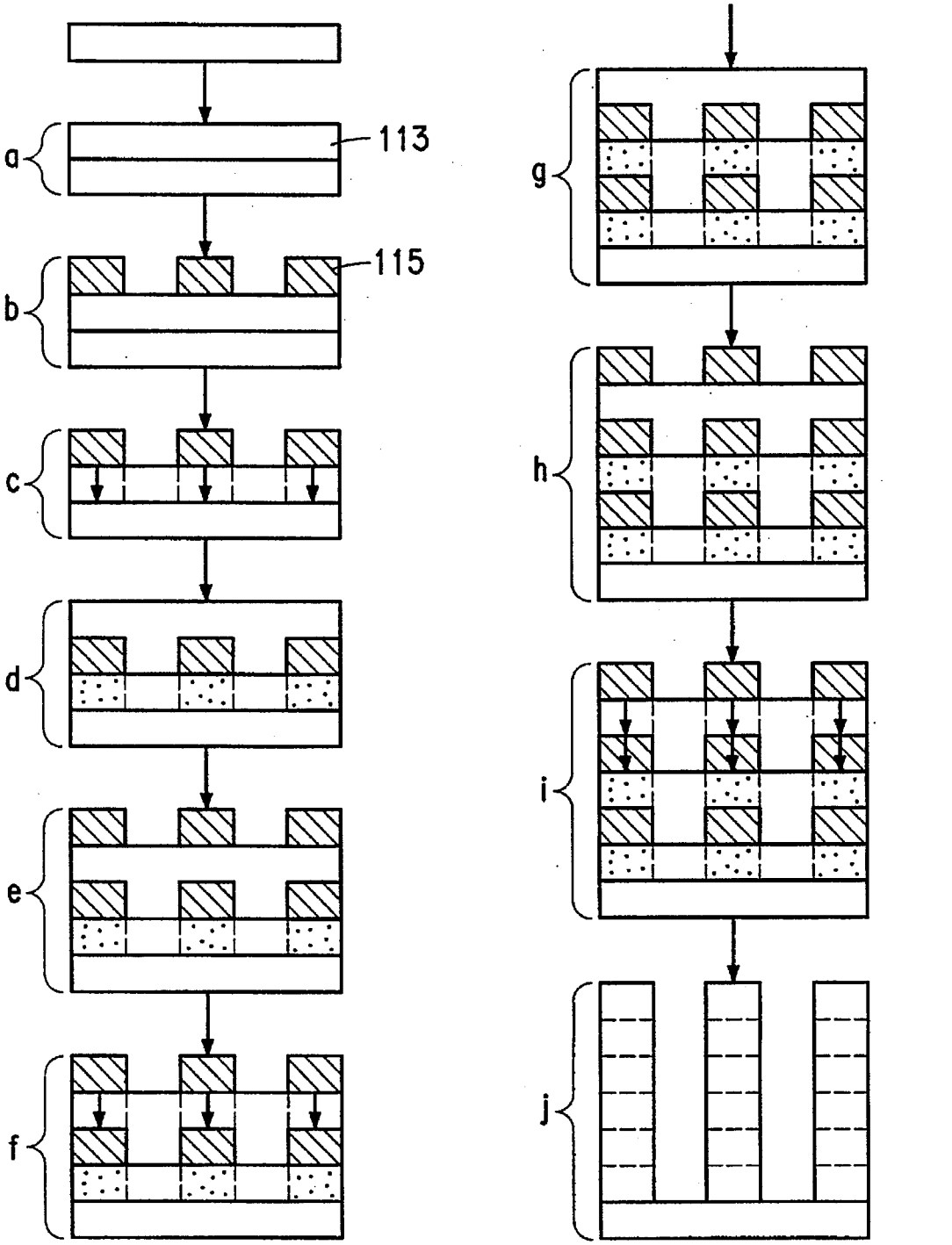
FIG. 9(*a–j*) contains a series of views illustrating sequence of steps 9-*a* to 9-*j* similar to those of FIG. 8 except that all of the patterned dielectric layers 115 but the uppermost one is kept after developing to make the ridges for the current invention.
Figure 10:
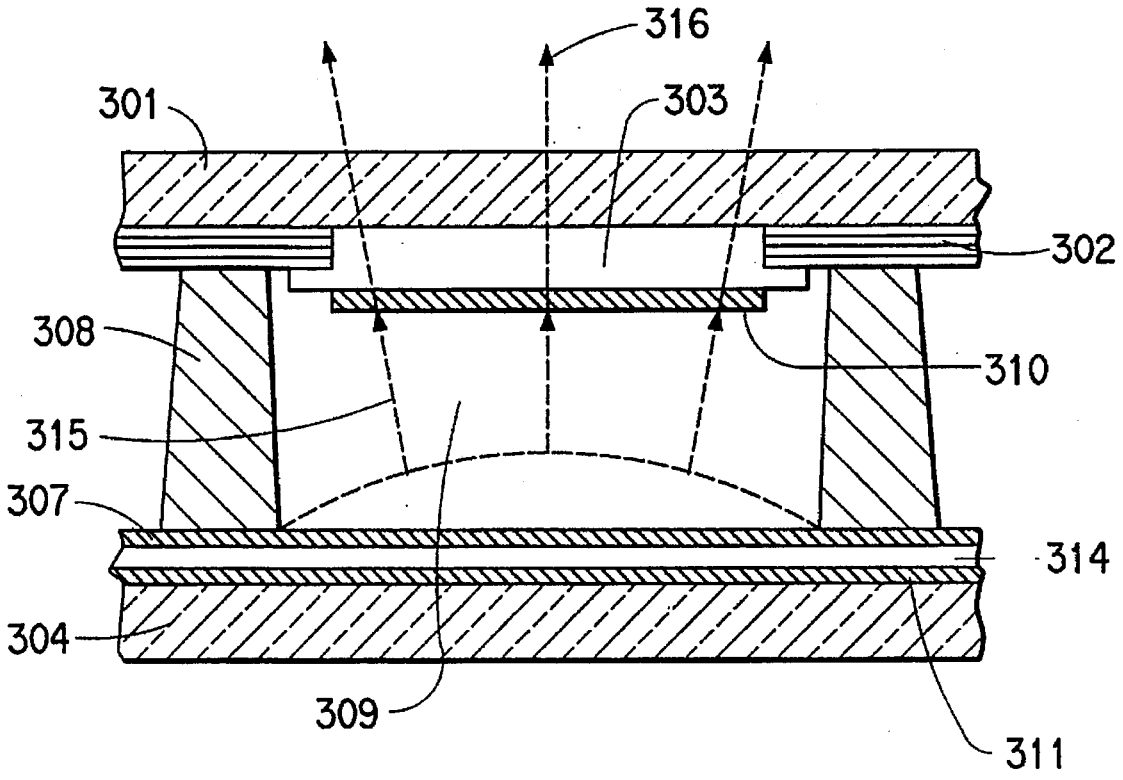
FIG. 10 (PRIOR ART)
FIG. 10 is a cross sectional view of a plasma display apparatus constructed in accordance with the prior art.

Alternatively, one may also reduce the number of developing step by using the process illustrated in FIGS. 8 and 9. FIG. 8 represents the case that the patterned layers are insoluble in the developing solvent depending on the thickness requirement, one may stop at step 8(*g*) or skip step 8(*g*) and complete the structure at 8(*k*). If the patterned layer became soluble after being depleted of the insolubilizing agent, only the uppermost patterned layer became insoluble since the lower patterned layers remain insoluble after receiving supply of desolubilizing agent from the patterned layer immediately above the said layer. This is illustrated in FIG. 9 (*f*) to (*i*).

FIGS. 8 and 9 can be summarized as follows:

FIG. 8

FIG. 8*a*—Dielectric print and dry

FIG. 8*b*—Print diffusion patterning layer

FIG. 8*c*—Diffusion

FIG. 8*d*—Print dielectric and dry

FIG. 8*e*—Print diffusion patterning layer

FIG. 8*f*—Diffusion

FIG. 8*g*—Develop

FIG. 8*h*—Print dielectric and dry

FIG. 8*i*—Print diffusion patterning layer

FIG. 8*j*—Diffusion

FIG. 8*k*—Develop

FIG. 9

FIG. 9*a*—Print dielectric and dry

FIG. 9*b*—Print diffusion patterning layer

FIG. 9*c*—Diffusion

FIG. 9*d*—Print dielectric and dry

FIG. 9*e*—Print diffusion patterning layer

FIG. 9*f*—Diffusion

FIG. 9*g*—Print dielectric and dry

FIG. 9*h*—Print diffusion patterning layer

FIG. 9*i*—Diffusion

FIG. 9*j*—Develop

The above method can also be applied to both substrates if desirable.

There are two types of plasma display apparatus described in the present application. The types, i.e., AC and DC type are described in terms of their electrode structure. The same ridge structure and method for producing ridges and materials can be used for manufacturing both types.

The following example illustrates the formulation of dielectric and patterning pastes.

EXAMPLE 1

Two pastes were formulated: One a dielectric paste, and one a patterning paste as follows:

| Dielectric Paste | |
|---|---|
| Glass A | 15.78 grams |
| Glass B | 0.83 |
| Alumina A | 7.89 |
| Alumina B | 3.24 |
| Cobalt Aluminate | 0.08 |
| Polymethyl methacrylate | 5.36 |
| Wetting Agent | 1.25 |
| t-Butylanthraquinone | 0.50 |
| Shell Ionol ® | 0.03 |
| Butyl Carbitole ®, Acetate | 14.10 |
| Butyl Benzyl Phthalate | 0.75 |
| **Glass A** | |
| $SiO_2$ | 56.2% wt. |
| PbO | 18.0 |
| $Al_2O_3$ | 8.6 |
| CaO | 7.4 |
| $B_2O_3$ | 4.5 |
| $Na_2O$ | 2.7 |
| $K_2O$ | 1.6 |
| MgO | 0.8 |
| $ZrO_2$ | 0.2 |

Glass A has a $D_{50}$ of ca. 4 to 4.5 microns; it is ($D_{10}$, $D_{50}$, or $D_{90}$, respectively, denotes the maximum particle diameter for 10, 50, or 90 weight % of the particles) milled and classified to remove coarse and fine fractions. Its $D_{10}$ is about 1.6 microns; and $D_{90}$ is 10–12 microns. Surface area is 1.5 to 1.8 $m^2/g$.

Glass B is a barium borosilicate glass used to lower the sintering temperature of the dielectric composite, due to the large particle size of glass A. Its formula follows:

| | |
|---|---|
| BaO | 37.5% wt. |
| $B_2O_3$ | 38.3 |
| $SiO_2$ | 16.5 |
| MgO | 4.3 |
| $ZrO_2$ | 3.0 |

Alumina A is a 1 micron powder with a narrow particle size distribution: $D_{10}$, $D_{50}$, and $D_{90}$ are, respectively, ca. 0.5, 1.1, and 2.7 microns. It is classified by settling to remove coarses and fines. Surface area is about 2.7–2.8 $m^2/g$.

Alumina B is a 0.4 micron average particle size powder with surface area of about 5 $m^2/g$.

| Patterning Paste | |
|---|---|
| Alumina A | 60.0 grams |
| Hydrogenated Castor Oil | 1.4 |
| Mineral Spirits | 4.0 |
| Colorant | 2.2 |
| Ethyl Cellulose T-200 | 4.3 |
| Terpineol | 11.9 |
| Butyl Benzyl Phthalate | 16.2 |

The above paste compositions were prepared in the manner familiar to those skilled in formulation of thick film materials and were prepared for printing as follows:

The materials were processed by printing the dielectric optionally one, two, or three prints, with each print followed by drying 10 to 15 minutes at 80 to 90 degrees Celsius. The patterned layer was then printed by using a via fill screen with several sizes of via openings (via denotes an opened cavity in a dielectric film, it is normally filled with a conductive material to form a circuitry interconnection; however, the via cavity remains unfilled to form a discharge area in the present invention). The patterning paste was then dried at 80 to 100 degrees C. for 5 to 10 minutes.

The pattern was then generated in the dielectric by immersing the overprinted layers in 1.1.1-trichloroethane with ultrasonic agitation until the overprinted areas were removed and the areas under the overprinted patterning paste were dissolved away.

Vias as small as 5–7 mils were resolved in dielectric films as thick as 85 microns, with good edge definition. This is far superior both in resolution and in thickness achievable with a single patterning step with screen printing.

ALTERNATIVE MATERIAL SYSTEMS

There are many ways to use the selective solubilization principle to generate thick film patterns. The pattern may be positive or negative working, i.e. the area under the overprint may either be solubilized, as in Examples 2–3 or it may be insolubilized, for example by overprinting an aqueously developable polymer with a water incompatible plasticizer to protect the areas underneath, then removing the unplasticized material by aqueous solubilization.

The following Table illustrates a number of acrylic polymer/plasticizer/solvent systems which have been demonstrated for use in the method of the invention.

| Alternative Acrylic Material Systems | | | |
|---|---|---|---|
| | Overprint | | |
| Underprint Resin | Solubilizer (Negative) | Desolubilizer (Positive) | Patterning Solvent |
| Polymethylmethacrylate Phthalate | Methyl Chloroform | | Dibutyl |
| Polymethylacrylate | Butyl Benzyl-Phthalate Ethylhydroxyethyl cellulose | Polymethyl methacrylate | Ethanol/ water/ ammonia |
| Carboset ® XPD-1234 | Triethanol amine | Dibutyl Phthalate | Water $K_2CO_3$/ Water |

The above resins may be combined. For example, methyl and ethyl methacrylate may be combined to allow positive or negative working resists. In the case of methyl methacrylate/ethyl methacrylate combinations, plasticizers such as triethylene glycol would produce a negative working resist in ethanol pattern generating solvent.

The following examples illustrate the paste formulation which have been demonstrated for fabricating the plasma display according to the invention.

EXAMPLES 2 AND 3

Aqueous Diffusion Patterning

A calcium zinc silicate glass was formulated with a cellulosic vehicle and 3% butyl benzyl phthalate. A film of each paste was screen printed onto a glass substrate and dried at 95°–100° C. A patterning paste containing 7 g alumina, 3.5 g Tergitol® TMN-6, 3.15 of terpineol isomers and 0.35 g ethyl cellulose was screen printed onto the dried dielectric paste layers and heated at 95°–100° C. to dry the overprinted paste and to effect diffusion of the Tergitol detergent into the underlying dielectric layer. When the dried layer was washed under tap water, six mil vias were clearly resolved. In subsequent tests, it was shown that the use of additional plasticizer in the underlying polymer layer improved resolution still further.

It is preferred to carry out the diffusion patterning process to fabricate a partition wall in the plasma display apparatus as described in Examples 2–3. Nevertheless, it can be carried out by other methods, for example by overprinting an aqueous developable polymer with a water incompatible plasticizer to protect the areas underneath, then removing the unplasticized material by aqueous solubilization.

We claim:

1. A process of making a plasma display apparatus, comprising the steps of providing dielectric substrates; forming plurality of first electrodes on one of said substrates to extend in one direction; forming a plurality of second electrodes on the other substrate to extend in another direction perpendicular to said one direction; forming a ridge on at least one of said substrates to define a plurality of pixel areas; and providing fluorescent materials in said pixel areas, the improvement in which the ridge is fabricated by a negative-acting diffusion patterning process by which a patterned layer of dielectric and an underlying unpatterned layer of dielectric are applied onto at least one of the substrates and the patterned layer formed with an image of said ridge is diffused into said unpatterned layer.

2. The process of claim 1 wherein the diffusion patterning process is a positive-acting diffusion patterning process.

3. A process of making a plasma display apparatus, comprising the steps of providing dielectric substrates, forming a plurality of first electrodes on one of the substrates to extend in one direction; forming a plurality of second electrodes on the same substrate to extend in another direction perpendicular to the direction of the first electrodes; forming a layer of dielectric to insulate the first from the second electrodes; forming a ridge on at least one of the substrates to define a plurality of pixel areas; and providing fluorescent materials in the pixel areas;

the improvement in which the ridge is fabricated by a negative-acting diffusion patterning process by which a patterned layer of dielectric and an underlying unpatterned layer of dielectric are applied onto at least one of the substrates and the patterned layer formed with an image of the ridge is diffused into the unpatterned layer.

4. The process of claim 3 wherein the diffusion patterning process is a positive-acting diffusion patterning process.

* * * * *